United States Patent [19]

Yeh

[11] 4,187,031

[45] Feb. 5, 1980

[54] KOREAN (HANGUL) ELECTRONIC TYPEWRITER AND COMMUNICATION EQUIPMENT SYSTEM

[76] Inventor: Chan H. Yeh, 532 Mercury Dr., Sunnyvale, Calif. 94086

[21] Appl. No.: 885,571

[22] Filed: Mar. 13, 1978

[51] Int. Cl.[2] ..... B41J 3/10; B41J 3/46; B41J 5/10

[52] U.S. Cl. ..... 400/83; 400/110; 400/121; 400/484

[58] Field of Search ..... 400/83, 84, 110, 124, 400/484, 118–121; 364/200 MS File, 900 MS File

[56] References Cited

U.S. PATENT DOCUMENTS

| | | | |
|---|---|---|---|
| 3,820,644 | 6/1974 | Yeh | 400/110 |
| 3,852,720 | 12/1974 | Park | 400/110 X |
| 4,124,843 | 11/1978 | Bramson et al. | 400/83 X |

*Primary Examiner*—Paul T. Sewell

*Attorney, Agent, or Firm*—Wenderoth, Lind & Ponack

[57] ABSTRACT

A Korean language typewriter system for reproducing Korean words. A keyboard has keys for each of the word arrangements of Korean alphabet elements into words and the respective keys generate a binary number signal corresponding to a respective one of the arrangements. Further keys for each of the plurality of alphabet elements of the Korean alphabet generate a binary number signal corresponding to a respective one of the alphabet elements. A memory stores sets of hexadecimal numbers each representing an elementary alphabet element on a matrix of a predetermined size. A computer connected between the keyboard has a display device for displaying a word arrangement pattern of spaces corresponding to one of the arrangements of Korean alphabet elements into words in response to a binary number signal for such a word arrangement from the keyboard and retrieves stored sets of hexademical numbers representing alphabet elements in response to binary number signals for such elements to fill the spaces in the word arrangement pattern and displays the matrix patterns of the alphabet elements in the spaces in the sequence in which the binary number signals for the alphabet elements are received from the keyboard. A matrix printer is connected to the computer for printing out only the matrix patterns for the alphabet elements arranged in the word arrangement pattern of spaces for representing a Korean word.

4 Claims, 12 Drawing Figures

FIG. 1
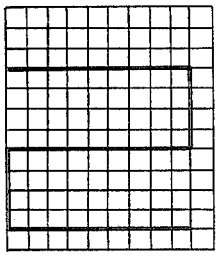
FIG. 2
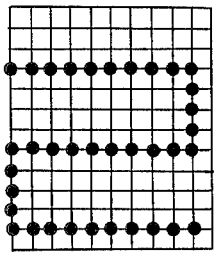
FIG. 3
| | | | | | | | | | |
|---|---|---|---|---|---|---|---|---|---|
| 0 | 0 | 0 | 0 | 0 | 0 | 0 | 0 | 0 | 0 |
| 0 | 0 | 0 | 0 | 0 | 0 | 0 | 0 | 0 | 0 |
| 1 | 1 | 1 | 1 | 1 | 1 | 1 | 1 | 1 | 1 |
| 0 | 0 | 0 | 0 | 0 | 0 | 0 | 0 | 0 | 1 |
| 0 | 0 | 0 | 0 | 0 | 0 | 0 | 0 | 0 | 1 |
| 0 | 0 | 0 | 0 | 0 | 0 | 0 | 0 | 0 | 1 |
| 1 | 1 | 1 | 1 | 1 | 1 | 1 | 1 | 1 | 1 |
| 1 | 0 | 0 | 0 | 0 | 0 | 0 | 0 | 0 | 0 |
| 1 | 0 | 0 | 0 | 0 | 0 | 0 | 0 | 0 | 0 |
| 1 | 0 | 0 | 0 | 0 | 0 | 0 | 0 | 0 | 0 |
| 1 | 1 | 1 | 1 | 1 | 1 | 1 | 1 | 1 | 1 |
| 0 | 0 | 0 | 0 | 0 | 0 | 0 | 0 | 0 | 0 |
FIG. 4
| | | |
|---|---|---|
| 0 | 0 | 0 |
| 0 | 0 | 0 |
| 3 | F | F |
| 0 | 0 | 1 |
| 0 | 0 | 1 |
| 0 | 0 | 1 |
| 3 | F | F |
| 2 | 0 | 0 |
| 2 | 0 | 0 |
| 2 | 0 | 0 |
| 3 | F | F |
| 0 | 0 | 0 |
FIG. 5
| Binary Code of Korean Alphabet ㄹ | Hexadecimal Code of Korean Alphabet ㄹ |
|---|---|
| 0000100 | 000 |
| | 000 |
| | 3FF |
| | 001 |
| | 001 |
| | 001 |
| | 3FF |
| | 200 |
| | 200 |
| | 200 |
| | 3FF |
| | 000 |
FIG. 8
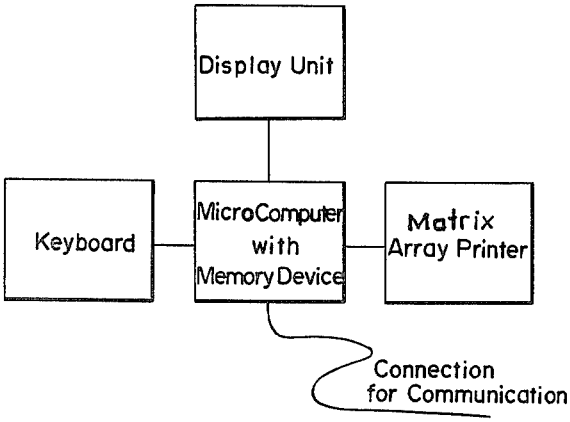
FIG. 9A
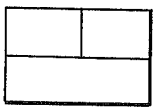
FIG. 9B
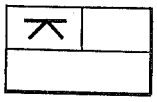
FIG. 9C
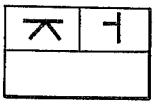
FIG. 9D
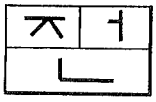

KOREAN (HANGUL) ELECTRONIC TYPEWRITER AND COMMUNICATION EQUIPMENT SYSTEM

BACKGROUND OF THE INVENTION

The written language used in Korea at this time includes 1800 Chinese characters that are officially approved and the Korean phonetic words. The ratio of usage of Chinese characters to Korean phonetic words in the current publications in Korea namely newspapers, magazines and books is approximately 1 to 5. In practice, the complete elimination of Chinese characters is not a matter of impossibility, but merely is a matter of inconvenience. As for current popular novels in Korea are concerned, many writers and publishers like to use only Korean phonetic words without a mix of Chinese characters. Furthermore, in order to facilitate telecommunication, Chinese characters have already been replaced by Korean phonetic words in the telegraphs of some news agencies.

The phonetic words used in the Korean language are essentially composed of 24 letters including 14 vowels and 10 consonants. In addition, there are 12 kinds of special compositions of the phonetic words of frequent occurence and 4 kinds provided for beauty purpose (as shown in the accompanying chart 1 through 5). Although the Korean language adopts phonetic words (phonetic spelling), the method of arrangement of its syllabic alphabet is different from the method of spelling in the Roman language system. Being influenced by the Chinese culture perhaps, the construction style of Korean phonetic words is much like that of Chinese characters which is square. This will be easily understood from the following explanation with reference to an example of the English word "MARKET." Assuming that English letters are equivalent to Korean syllabic alphabet elements, the word "MARKET" will be arranged in accordance with the common practice of the arrangement of Korean phonetic words as:

| | |
|---|---|
| M A | K E |
| R | T |

For the aforesaid reason the operator has to move up and down and right and left when typing with a Korean typewriter in order to type out the phonetic words in a square style. However, it is not really this simple. To explain this, reference is made to the following example:

"가" is composed of two Korean syllabic letters ㄱ and ㅏ.

"글" is composed of four Korean syllabic letters ㄱ, ㅡ, ㄹ, and ㅡ.

It should be noted here that the sizes and positions of the same syllabic character "ㄱ" used in the above mentioned two words are different from each other. According to the inventor's study there are fifteen different forms of arrangement (that is, the positions in which Korean syllabic alphabet elements are arranged) and four different sizes of Korean syllabic alphabet-element which constitute the structure style of Korean phonetic words. In order to write desired Korean phonetic words the proper combination of these forms and sizes are required. However, because the typewriters currently used in Korea can only perform movements up-and-down and left-to-right, and have only two different sizes of the syllabic alphabet elements currently available, therefore the Korean words typed therefrom not only lack beauty but also are different from the original words in style.

Some examples of comparisons of words made up of Korean phonetic alphabet elements are shown as follows:

| original words | typed words |
|---|---|
| 한 | 한 |
| 전 | 전 |
| 발 | 발 |
| 점 | 점 |

The difficulties in typing desired Korean Phonetic words even with the aid of the currently most advanced Korean typewriters can be understood from the examples illustrated above—that is not only are the styles and sizes of Korean syllabic alphabet elements improper but also the arrangement of the syllabic alphabet elements in proper size and in proper position are different from what are required in the original words. The arrangement of the syllabic alphabet is in fact a unique feature of Korean phonetic words and also is the main obstacle to the computer data processing of Korean phonetic words. In order to enable computer data processing of Korean phonetic words the entire Korean country has been given extensive encouragement to carry out a program of development, but no progress has been made yet and there is still no Korean typewriter that is more or less satisfactory.

The object of this invention is to provide a novel method and equipment for data processing for Korean phonetic words so that the above-mentioned problems of typing and difficulties in data processing of Korean phonetic words can be solved.

Another object of this invention is to facilitate the electronic data processing of Korean phonetic words by the classification and formulation of the construction styles of Korean phonetic words in fifteen forms of arrangement of syllabic alphabet, in which each form is designated by a specific code composed of seven binary numbers.

Still another object of this invention is to provide a Korean electronic typewriter that processes the Korean phonetic words which are designated by two to six binary numbers, which are stored in a computer memory device and type out by a dot matrix typing head as required when the appropriate keys are pressed.

A further object of this invention is to provide a Korean electronic typewriter and communication equipment system with the aid of which the Korean phonetic words are computerized and designated specific computer codes composed of eight binary numbers and transmitted by the output signals of the electronic typewriter through communication lines to a remote location, or received from a remote location and typed out.

BRIEF DESCRIPTION OF THE CHARTS AND DRAWINGS

The aforesaid objects and other objects as well as the functions and the features of this invention will be more fully understood from the following description taken in conjunction with the accompanying drawings.

Chart 1 shows the Korean alphabet elements provided upon the keyboard of a Korean electronic typewriter of this invention and their computer codes of seven binary numbers assigned to each alphabet element.

Chart 2 shows specially composed combinations Korean syllabic alphabet elements which occur frequently and used in the keyboard of the Korean electronic typewriter of this invention, and their corresponding computer codes.

Chart 3 shows specially composed combinations of Korean syllabic alphabet elements for proper appearance (as compared to the improper appearance produced by prior art devices) provided upon the keyboard of the Korean electronic typewriter of this invention and their corresponding computer codes.

Chart 4 shows the fifteen classified and formulated forms of Korean words provided upon the keyboard of the Korean electronic typewriter of this invention and their corresponding computer codes.

Chart 5 shows digits (including 0) and punctuation marks and mathematical symbols that are frequently used, both of which are also provided upon the keyboard of the Korean electronic typewriter of this invention, and their corresponding computer codes.

FIG. 1 shows the arrangement of a Korean alphabet element "ㄹ" on a 10×12 array.

FIG. 2 shows the arrangement of dots forming a Korean alphabet element "ㄹ" on a 10×12 matrix.

FIG. 3 is a matrix chart of binary numbers for a Korean alphabet element "ㄹ" in a 10×12 matrix.

FIG. 4 is a matrix chart of thirty-six hexadecimal numbers of the Korean alphabet element "ㄹ" converted from the matrix chart of FIG. 3.

FIG. 5 shows a computer code representing the Korean alphabet element "ㄹ" to be stored in a computer memory device, which consists of seven binary numbers designated further by the thirty-six hexadecimal numbers shown in FIG. 4.

FIG. 8 is a block diagram showing the construction of the Korean electronic typewriter and its relation with communication equipment according to this invention.

FIGS. 9A–9D are illustrations of operation procedure of the Korean electronic typewriter according to this invention.

DESCRIPTION OF THE PREFERRED EMBODIMENTS

In order to facilitate the explanation, thereof, the Korean alphabet element "ㄹ" will be taken as an example. In this invention, first of all, each Korean element is indicated on a 10×12 matrix as the basic alphabet pattern of each element as shown in FIG. 1, FIG. 2 and FIG. 3. Then each basic alphabet element pattern is converted to thirty-six hexadecimal numbers (see FIG. 4) to be further stored in the computer memory device as the patterns of the Korean alphabet element (that is, the patterns of all twenty-four Korean alphabet elements are stored in the computer memory device.), each said alphabet element being designated by a specific code composed of seven binary numbers as shown in FIG. 5.

Furthermore, each Korean phonetic word is indicated on a 20×24 array. Since each Korean phonetic word is composed of various alphabet elements of different sizes, the proper sizes of the alphabet elements can be obtained by a computer program for enlarging or shrinking the element, such as by means of a character editing program available from Ideographix Inc., 532 Mercury Drive, Sunnyvale, CA, 94086, and which can be used to program most standard computers, when the size of an alphabet element is different comparatively from that of the basic alphabet element pattern thereof. Therefore, the Korean words typed by the electronic typewriter of this invention are in the proper size, are neat and beautiful, and thus the beautiful structure style of original Korean words can be expressed with fidelity.

Figure 6:
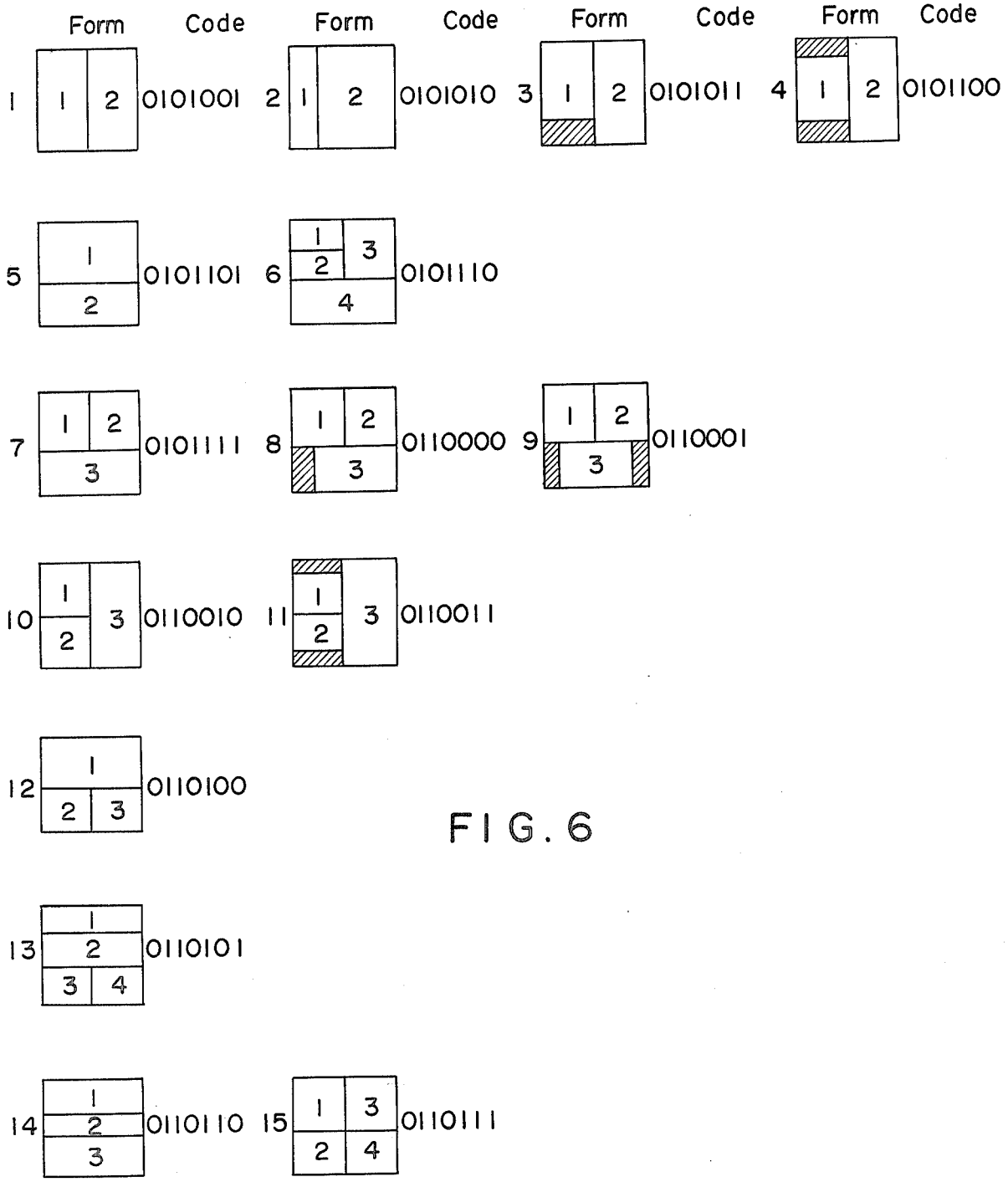
FIG. 6 shows fifteen classified forms of Korean phonetic word structure in accordance with this invention, in which the portions marked with hatching lines are not included in the matrix. The digits noted in the frames of each form indicate the sequential order of writing the Korean alphabet elements to form a word.

There are as many as fifteen different forms of the Korean phonetic words according to the inventor's research. As shown in FIG. 6, each form is designated with a specific code composed of seven binary numbers for the identification of the selected form. The digits shown in the frames indicate the sequence in which the respective alphabet elements are formed during the operation. The portions with hatching lines within the square frame indicate the areas that are provided for spaces to give the proper style to the Korean character. These are the unique features of Korean words. These codes for the forms shown in FIG. 6 are stored for retrieval when desired.

Figure 7:
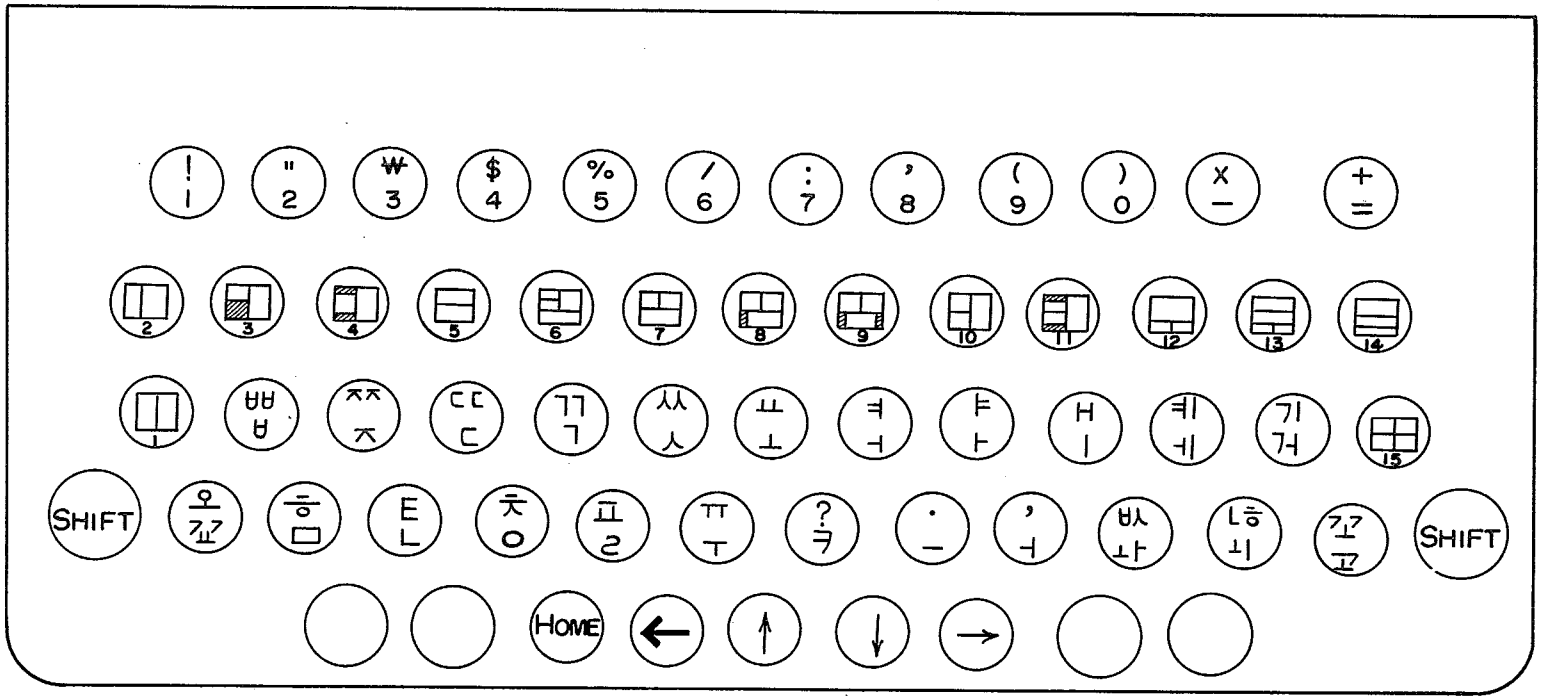
FIG. 7 shows the arrangement of the keyboard of the Korean electronic typewriter, the Korean alphabet elements, various related marks and the like represented respectively by each key according to this invention.

Referring now to FIG. 7, keys for the twenty-four Korean alphabet elements, sets of some symbols of frequent occurrence that are composed of two alphabet elements (such as ㅂㅅ, ㄴㅎ, etc.) and fifteen different forms are all provided upon the keyboard respectively, and keys for those symbols that do not occur frequently and that are composed of sets of two Korean alphabet elements and that are provided for beauty purpose such as ㅗㅈ and ㄱㅈ are also provided. In addition, the keyboard also has keys for common marks and for required controls as well as some spare keys that are reserved for possible future additions to the forms of application and for some more special symbols of frequent occurrence.

The Korean electronic typewriter of this invention mainly consists of a matrix printer, such as a Model 1800 or Model 3000 printer available from Ideographix, Inc., a micro computer with a memory device, such as a Nova 4 or Micronova, available from Data General Corporation, and a keyboard and a display unit as shown by the block diagram in FIG. 8, such as a Model 2400 microdisplay available from Ideographix, Inc.

The operation of the Korean electronic typewriter of this invention is as follows, taking the Korean word "전" as an example. First, the operator presses the key for the form the word (No. 7 key for form), and the code for this form is retrieved from the memory device and the square picture of FIG. 9A is then shown in the display unit for the operator's verification but the matrix printer does not function yet. When the operator proceeds to press down the key for alphabet element "ㅈ," the code for this element is retrieved, and the size of the alphabet element is automatically reduced by the computer and supplied to the display unit as the pattern of FIG. 9B. When the operator presses the key for alphabet element "ㅓ," the size thereof is reduced by the computer, and then it is supplied to the display unit as the pattern of FIG. 9C. When the key for alphabet element "ㄴ" is finally pressed, the computer automatically enlarges the pattern of the alphabet element which is then supplied to the display unit as the pattern of FIG. 9D. The Korean phonetic word "전" thus composed is then printed out with the aid of the matrix printer in accordance with the stored arrays of patterns in the computer memory device. As described above any Korean word can be composed and shown in the display unit and printed by the matrix printer. However, the square frame for the form will not be printed out.

In order to enable the transmission of thus composed Korean words to a remote location through communication lines, each Korean alphabet has to be designated with a computer code for the read-out and read-in processes. This will be explained by taking the word "전" as an embodying example. First of all, it is found from FIG. 6 that said word belongs to the class having the No. 7 form, the designated computer code for which is 00101111, the designated computer code for alphabet element "ㅈ" being 00001001, the designated computer code for alphabet element "ㅓ" being 0001001, and that for alphabet element "ㄴ" being 00000010. Therefore, the designated computer codes for the word "전" will be the four binary codes 00101111, 00001001, 00010001 and 00000010. Other Korean words are of course not necessarily all designated with four binary codes. The could be designated two (i.e. one for form one for the character) to six (i.e. one for the form, five for the five characters) binary codes or more. Therefore, when the computer codes representing Korean words are being transmitted to a remote location by the computer said computer codes can be decoded, when received at the remote distance, into corresponding forms and basic alphabet patterns. The size of said basic alphabet patterns is dependent upon the arrangement of alphabet elements in said forms. After the chosen alphabet patterns are filled into prearranged positions, the complete Korean phonetic words will be displayed and then printed perfectly. In a word, all the aforesaid processes are performed at electronic speed.

A supplementary explanation must be given that each computer code for Korean phonetic words consists of seven binary numbers when used for printing or used for typewriter application. However, each computer code will have eight binary numbers when used in communication equipment in order to distinguish therebetween and to facilitate the processing, each computer code designating the form being prefixed with "1" and that for designating alphabet elements being prefixed with "0" for identification.

It should be further explained here that in the aforesaid description of this invention the size of matrix used for the Korean alphabet elements and that used for the Korean words, and the hexadecimal numbers used for conversion are provided because of the size of Chinese characters which may be used in combination with Korean. It is to be understood that the foregoing description is merely for illustration, and it is not intended to limit this invention by what as been described.

Chart 1:

KOREAN ALPHABETS AND THEIR COMPUTER CODES

| Serial No. | Korean Alphabet | Code | Serial No. | Korean Alphabet | Code | Serial No. | Korean Alphabet | Code |
|---|---|---|---|---|---|---|---|---|
| 1 | ㄱ | 0000001 | 11 | ㅋ | 0001011 | 21 | ㅐ | 0010101 |
| 2 | ㄴ | 0000010 | 12 | ㅌ | 0001100 | 22 | ㅠ | 0010110 |
| 3 | ㄷ | 0000011 | 13 | ㅍ | 0001101 | 23 | ㅡ | 0010111 |
| 4 | ㄹ | 0000100 | 14 | ㅎ | 0001110 | 24 | ㅣ | 0011000 |
| 5 | ㅁ | 0000101 | 15 | ㅏ | 0001111 | | | |
| 6 | ㅂ | 0000110 | 16 | ㅜ | 0010000 | | | |
| 7 | ㅅ | 0000111 | 17 | ㅓ | 0010001 | | | |
| 8 | ㅇ | 0001000 | 18 | ㅕ | 0010010 | | | |
| 9 | ㅈ | 0001001 | 19 | ㅗ | 0010011 | | | |
| 10 | ㅊ | 0001010 | 20 | ㅛ | 0010100 | | | |

Chart 2:

SPECIALLY COMPOSED KOREAN ALPHABETS OF FREQUENT OCCURENCE AND THEIR COMPUTER CODES

| Serial No. | Composed Korean Alphabets Thereof | Code | Serial No. | Composed Korean Alphabets Thereof | Code | Serial No. | Composed Korean Alphabets Thereof | Code |
|---|---|---|---|---|---|---|---|---|
| 25 | ㅂㅅ | 0011001 | 29 | ㄱㅣ | 0011101 | 33 | ㄷㄷ | 0100001 |
| 26 | ㄴㅎ | 0011010 | 30 | ㄱㅓ | 0011110 | 34 | ㄱㄱ | 0100010 |
| 27 | ㅗㅏ | 0011011 | 31 | ㅂㅂ | 0011111 | 35 | ㅅㅅ | 0100011 |
| 28 | ㅗㅣ | 0011100 | 32 | ㅈㅈ | 0100000 | 36 | ㅓ | 0100100 |

Chart 3:

COMPOSED KOREAN ALPHABETS PROVIDED FOR BEAUTY PURPOSE AND THEIR COMPUTER CODES

| Serial No. | Composed Korean Alphabets Thereof | Code |
|---|---|---|
| 3737 | ㅈㅏ | 0100101 |
| 38 | ㅈㅐ | 0100110 |
| 39 | ㅈㅔ | 0100111 |
| 40 | ㅇㅡ | 0101000 |

Chart 4:

FORMS OF KOREAN WORDS AND THEIR COMPUTER CODES

| Serial No. | Fifteen Forms Thereof | Code | Serial No. | Fifteen Forms Thereof | Code |
|---|---|---|---|---|---|
| 41 | Form 1 | 0101001 | 51 | Form 11 | 0110011 |
| 42 | 2 | 0101010 | 52 | 12 | 0110100 |
| 43 | 3 | 0101011 | 53 | 13 | 0110101 |
| 44 | 4 | 0101100 | 54 | 14 | 0110110 |
| 45 | 5 | 0101101 | 55 | 15 | 0110111 |
| 46 | 6 | 0101110 | | | |
| 47 | 7 | 0101111 | | | |
| 48 | 8 | 0110000 | | | |
| 49 | 9 | 0110001 | | | |

Chart 4:-continued

| FORMS OF KOREAN WORDS AND THEIR COMPUTER CODES | | | | | |
|---|---|---|---|---|---|
| Serial No. | Fifteen Forms Thereof | Code | Serial No. | Fifteen Forms Thereof | Code |
| 50 | 10 | 0110010 | | | |

Chart 5:

| DIGITS AND MARKS AND THEIR COMPUTER CODES | | | | | |
|---|---|---|---|---|---|
| Serial No. | Digits and Marks | Code | Serial No. | Digits and Marks | Code |
| 56 | 1 | 0111000 | 70 | % | 1000110 |
| 57 | 2 | 0111001 | 71 | / | 1000111 |
| 58 | 3 | 0111010 | 72 | ; | 1001000 |
| 59 | 4 | 0111011 | 73 | , | 1001001 |
| 60 | 5 | 0111100 | 74 | ( | 1001010 |
| 61 | 6 | 0111101 | 75 | ) | 1001100 |
| 62 | 7 | 0111110 | 76 | × | 1001101 |
| 63 | 8 | 0111111 | 77 | — | 1001110 |
| 64 | 9 | 1000000 | 78 | + | 1001111 |
| 65 | 0 | 1000001 | 79 | ÷ | 1010000 |
| 66 | ! | 1000010 | 80 | = | 1010001 |
| 67 | " | 1000011 | 81 | ? | 1010010 |
| 68 | ₩ | 1000100 | 82 | . | 1010011 |
| 69 | $ | 1000101 | 83 | ㅍ | 1010100 |
| | | | 84 | ㅗ | 1010101 |
| | | | 85 | ㅓ | 1010110 |

I claim:

1. A Korean language typewriter system for reproducing Korean words, comprising a keyboard means having keys corresponding to each of the arrangements in which Korean alphabet elements are arranged into words and means connected to the respective keys for generating a binary number signal corresponding to a respective one of said arrangements when the corresponding key is actuated, further keys for each of the plurality of alphabet elements of the Korean alphabet and means connected to the respective further keys for generating a binary number signal corresponding to a respective one of said alphabet elements when the corresponding further key is actuated; storage means for storing sets of hexadecimal numbers each representing an elementary alphabet element on a matrix of a predetermined size; computer means connected between said signal generating means and said storage means and having a display means for displaying a word arrangement pattern of spaces corresponding to one of the arrangements of Korean alphabet elements into words in response to a binary number signal for such a word arrangement from said keyboard means and for retrieving stored sets of hexademical numbers respresenating alphabet elements in response to binary number signals for such elements to fill the spaces in said word arrangement pattern from said keyboard means, changing the size of the matrix pattern of the retrieved sets of hexadecimal numbers for causing the matrix patterns to fit in the corresponding spaces in the word arrangement pattern and then displaying the matrix patterns in the spaces in the sequence in which the binary number signals for the alphabet elements are received from said keyboard means; and matrix printer means connected to said computer means for printing out only the said matrix patterns for the alphabet elements arranged in the word arrangement pattern of spaces for representing a Korean word.

2. A Korean language typewriter system as claimed in claim 1 in which said keyboard means further has a plurality of additional keys each being for a frequently used combination of alphabet elements of the Korean alphabet, and further means connected to said additional keys for generating an additional binary number signal corresponding to a respective one of said combinations of alphabet elements when the corresponding additional key is actuated; said storage means including means for storing sets of additional hexadecimal numbers each representing a frequently used combination of alphabet elements of the Korean alphabet on a matrix of a predetermined size; said computer means having means for retrieving the stored sets of additional hexadecimal numbers in response to an additional binary number and displaying the combination of alphabet elements corresponding thereto.

3. A Korean language typewriter system as claimed in claim 2 in which said computer means further comprises means for prefixing the binary numbers representing an alphabet element with one form of binary element and for prefixing the binary numbers representing the arrangements with the other form of binary element, and for supplying the thus prefixed binary numbers to a transmission means for transmission as a series of signals corresponding to the prefixed binary numbers, whereby the Korean language can be transmitted to a corresponding typewriter and decoded and displayed.

4. A Korean language typewriter system as claimed in claim 2 in which said computer means further comprises means for receiving binary numbers representing an alphabet element with one form of binary element prefixed thereto and for receiving binary numbers representing the arrangements with another form of binary element prefixed thereto and for decoding said prefixed binary numbers and retrieving the hexadecimal numbers corresponding thereto for displaying the arrangements and the alphabet elements on said display means.

* * * * *